United States Patent [19]

Schott, Jr.

[11] 4,030,681

[45] June 21, 1977

[54] ROLL WINDER

[75] Inventor: Charles M. Schott, Jr., Gloucester, Mass.

[73] Assignee: Gloucester Engineering Co. Inc., Gloucester, Mass.

[22] Filed: Mar. 2, 1976

[21] Appl. No.: 663,211

[52] U.S. Cl. ..... 242/81; 242/68.3

[51] Int. Cl.[2] ..... B21C 47/00; B65H 17/02

[58] Field of Search ..... 242/81, 56 A, 78.1, 242/67.1 R, 67.2, 67.3 R, 68.4, 68, 55, DIG. 3

[56] References Cited

UNITED STATES PATENTS

| | | | |
|---|---|---|---|
| 3,042,335 | 7/1962 | Ensign | 242/81 |
| 3,695,542 | 10/1972 | Briggs | 242/81 |
| 3,733,035 | 5/1973 | Schott | 242/81 |
| 3,776,070 | 12/1973 | Stoffels | 242/68 |
| 3,802,639 | 4/1974 | Dowd | 242/68.3 |

*Primary Examiner*—Edward J. McCarthy

[57] ABSTRACT

A winder for plastic film in the absence of a winding core features equalized air lubrication of the wound roll, throughout its axial removal from the arbor. In the preferred embodiment in which a pair of aligned arbors move oppositely for stripping, means are provided for maintaining pressurized air at the roll-engaged support surfaces of both arbors until the arbors disengage the opposite ends of the roll. The winder has: restraints to hold the roll in position axially to ensure balanced air lubrication of the arbors during the stripping movement; means delivering the air adjacent the inner ends of the arbors, from which the air proceeds axially outwardly along both arbor surfaces to the ends of the roll; dependent driving of the arbors during the stripping motion; formations at the outer ends of the arbors engaged by axial drive devices; drive means receiving the end formations during indexing about a central major axis, to apply axial stripping and subsequent axial return forces to the arbors, releasing the arbors during subsequent indexing motion; axially extending flats on each of the arbors engaged by rollers in supporting and driving relation, the flats preferably extending to the inner ends of the arbors to ensure alignment with respective rollers; means for displacing a carrier for the rollers radially to cause the rollers to tightly engage the arbor, preferably comprising wedge formations responsive to axial force to displace the carrier radially; a circular friction surface drive for the carrier, and via the rollers mounted on the carrier, for the arbors; a piston urged by air pressure against the arbor end and a relief valve operable for admitting air through the piston when the piston is engaged upon the arbor; and a tucking means tucking the edge of film about a pair of arbors to initiate formation of the roll.

13 Claims, 13 Drawing Figures

FIG 1
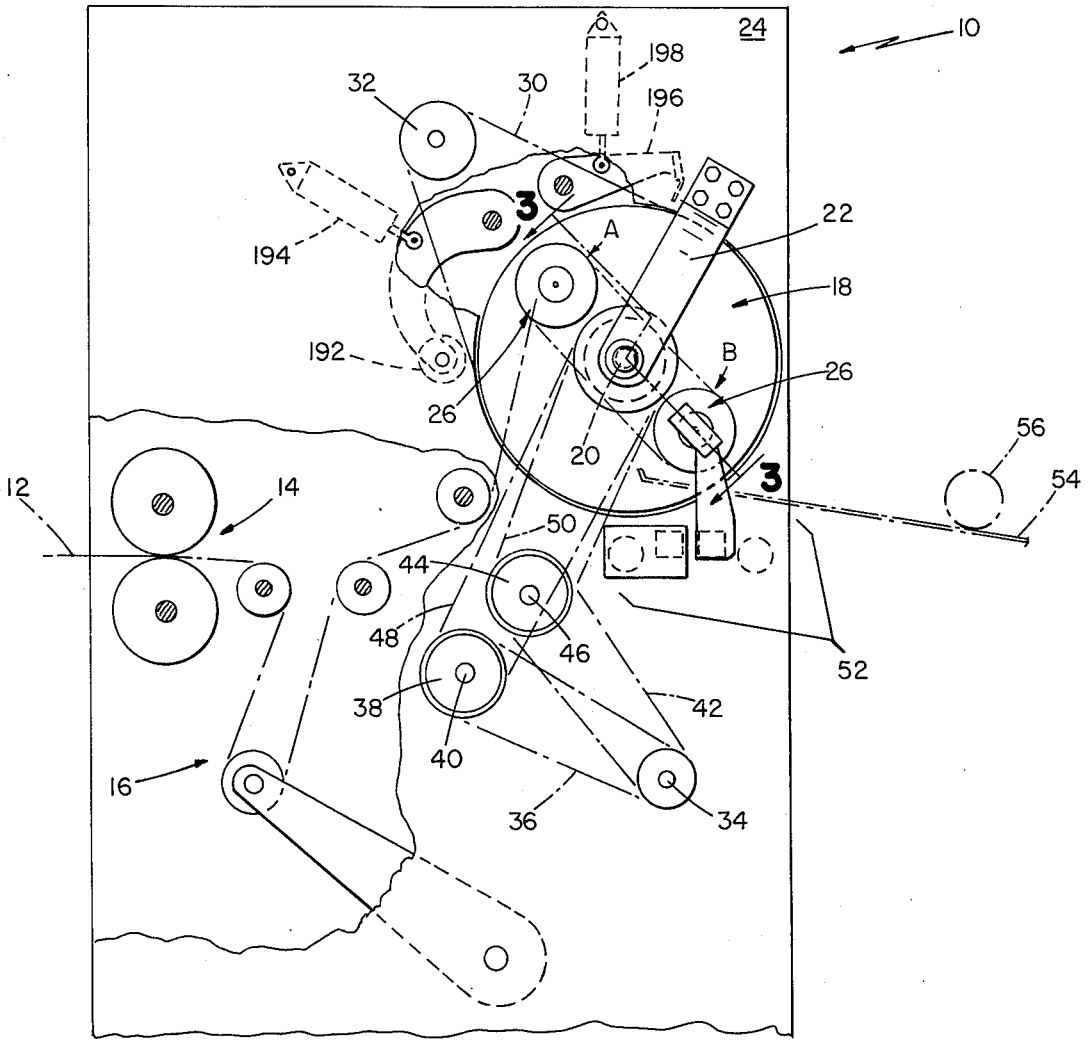
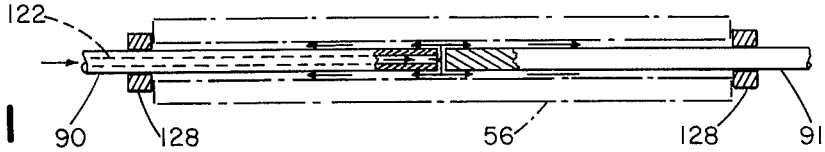
FIG 11
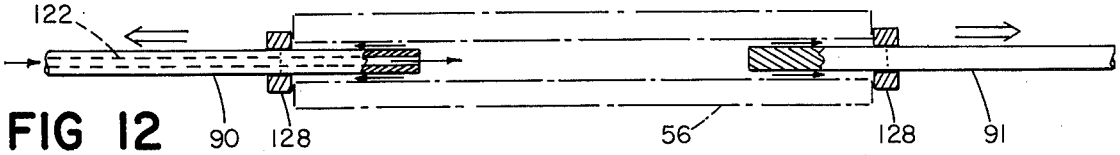
FIG 12

ROLL WINDER

BACKGROUND OF THE INVENTION

This invention relates to winding machines in which a continuous web is wound into rolls.

Rolls of web are frequently desired having small central holes since this makes a more compact packaging of a given length of web, gives a better appearance, and makes a roll less susceptable to crushing. Heretofore achieving small sized interior holes in web rolls has been limited by available winding arbor constructions which employed bulky mechanisms internal to the arbor to effect release of the frictional force between roll and arbor.

SUMMARY OF THE INVENTION

The primary object of this invention is to facilitate the extraction of a completed roll of web from a web winder, and particularly to facilitate the winding and extraction of a roll of web with small inside diameter.

The invention features in a winder suitable for winding a web in the absence of a core, and comprising arbor means, means for introducing air to the surface of the arbor, means for facilitating sliding of a roll produced on the arbor, and means engaging the roll for producing stripping motion of the roll relative to the arbor, the improvement comprising means localizing the introduction of the air along the length of the arbor through entry means defining substantially equal length flow paths between the roll and the arbor in each direction from the point of introduction of air to each end of the roll, until the roll leaves the arbor.

Embodiments of the invention feature a pair of axially aligned arbors, one protruding from each of two opposed side supports of the winder machine, the arbors movable axially toward each other to a winding position and movable away axially from each other for stripping from the wound roll, and means for introducing and maintaining pressurized air at the roll-engaged support surfaces of the arbors during the outward stripping movement of the arbors, until the arbors disengage the opposite ends of the roll. Embodiments of the invention additionally feature restraints arranged to engage the opposite ends of the roll to hold it in position axially during the stripping movement of the arbors; hollow arbors arranged to deliver the air to a space adjacent the inner ends of the arbors, from which space the air proceeds axially outwardly along the arbor surfaces to the ends of the roll; a dependent drive means for driving the arbors dependently during the stripping motion; arbors with formations at their outer ends adapted to be engaged by axial drive devices; arbors indexable about a central major axis from winding position to discharge position; drive means adapted to receive the end formations of the arbors during the indexing, to apply axial stripping force and subsequent axial return force to the arbors and to release the arbors during subsequent indexing motion from the release to the drive position; axially extending flats on each of the arbors and rollers engaging the flats in supporting and rotatable driving thereto; the extension of the flats to the inner ends of the arbors to ensure alignment of the arbors with their respective rollers; a carrier for the rollers and means for displacing the carrier radially toward the arbor axis to cause the rollers to tightly engage the arbor; wedge formations on the carrier and means to apply axial force thereto to displace the carrier in a radial direction; a circular friction surface to apply drive force from the machine drive to the carrier, and via the rollers mounted on the carrier, to the arbors; a piston responsive to air pressure to be resiliently urged against the end of an arbor and a relief value operable by air pressure for admitting air through the piston when the piston is engaged upon the arbor; and a tucking means arranged to tuck the leading edge of film about a pair of arbors to initiate the formation of a roll.

BRIEF DESCRIPTION OF DRAWING

FIG. 1 shows in side view a web winding machine embodying the invention.

FIG. 11 shows a stage in the operation of the machine, and

FIG. 12 shows a subsequent stage.

DESCRIPTION OF PREFERRED EMBODIMENT

Figure 2:
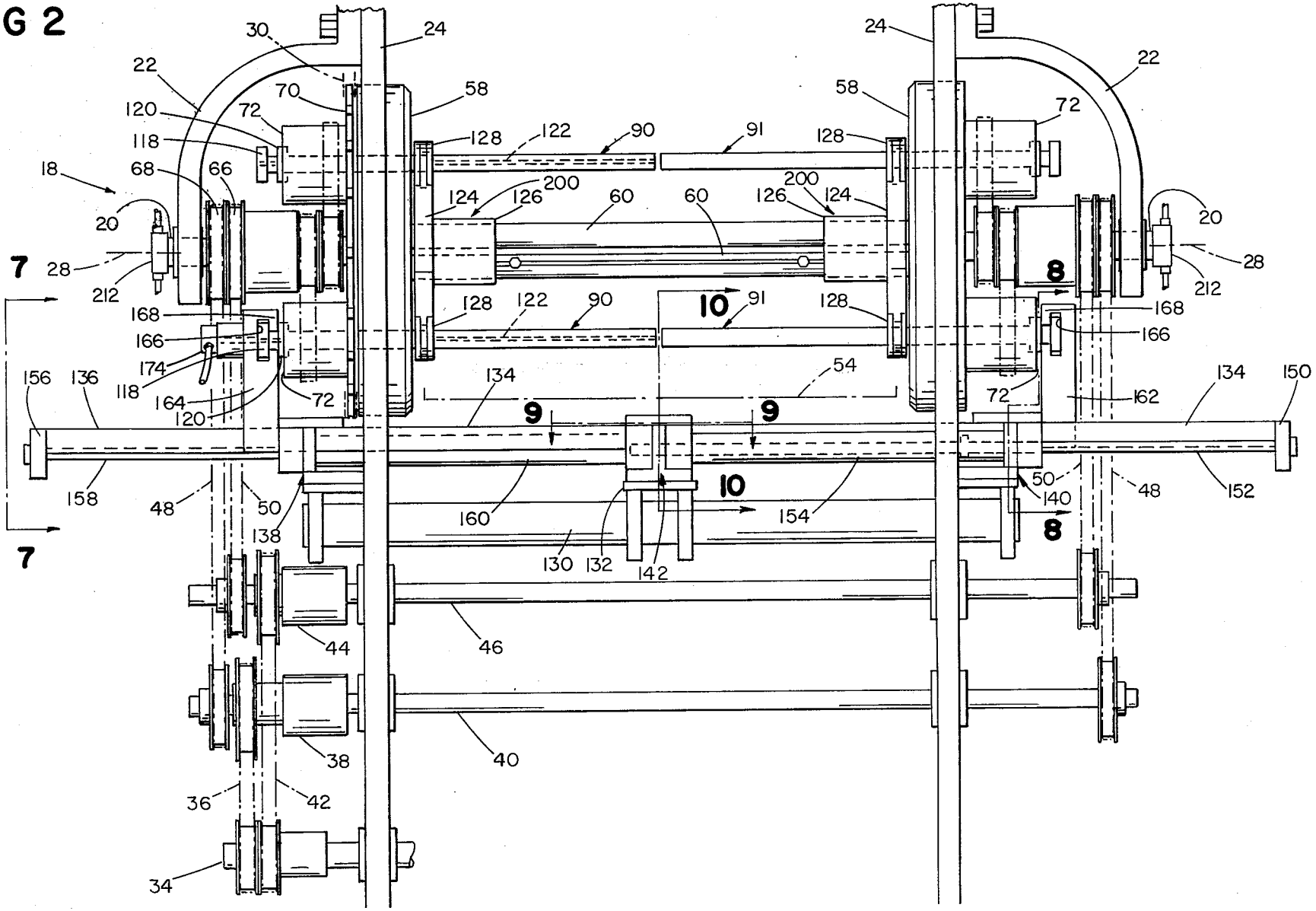
FIG. 2 shows a front view of the machine of FIG. 1 with some parts removed for clarity.

A web winding machine 10 embodying the invention is shown somewhat schematically in FIG. 1. Continous web 12 entering machine 10 passes through nip rolls 14, dancer mechanism 16 and enters winding turret 18, which is supported through axle 20 and brackets 22 on side supports 24. Winding turret 18 has two spooling mechanisms 26 arranged symmetrically about its axis 28. In general terms, web is wound on one spooling mechanism positioned at station A while a roll previously wound is extracted from the other mechanism positioned at station B. When these operations are completed turret 18 is rotated to move the completed roll to position B and the empty winding mechanism to position A, and the operations are repeated cyclically. Turret 18 is connected through sprocket chain 30 to drive gear 32. Drive 34 is connected through belt 36 and clutch 38 to jack shaft 40 and through belt 42 and clutch 44 to jackshaft 46. Belts 48 and 50 connect jackshafts 40 and 46 to elements in the turret as will be described hereafter. Extraction mechanism 52 is mounted on supports 24 near station B, delivery chute 54 delivers finished spools 56 from the machine.

Figure 3:
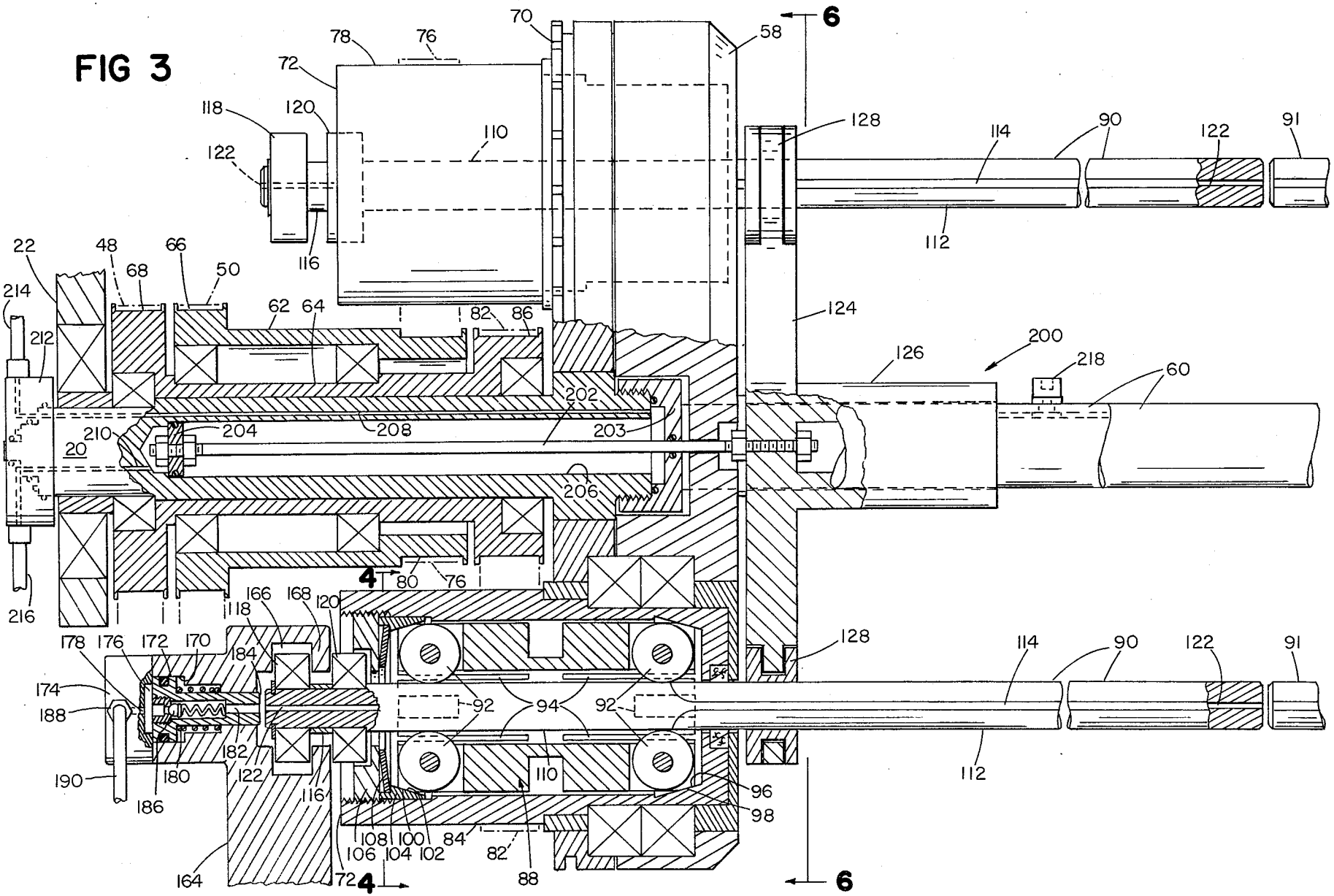
FIG. 3 shows the turret of the machine of FIG. 1 on view 3—3.
Figure 4:
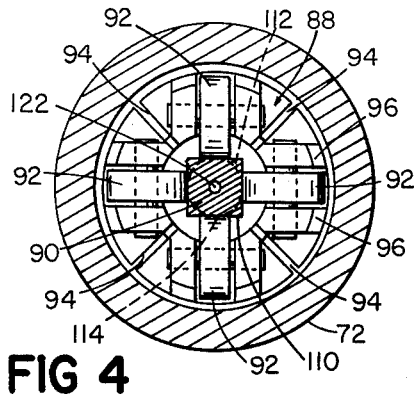
FIG. 4 shows a spindle shown in FIG. 3 along section 4—4.
Figure 5:
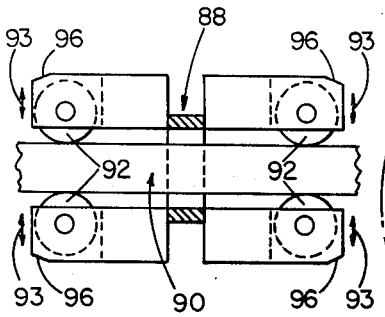
FIG. 5 shows the flexure of the carrier shown in FIG. 4.
Figure 6:
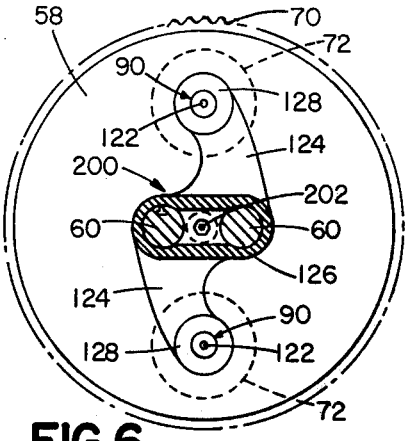
FIG. 6 shows a view of the turret of FIG. 3 along section 6—6.
Figure 7:
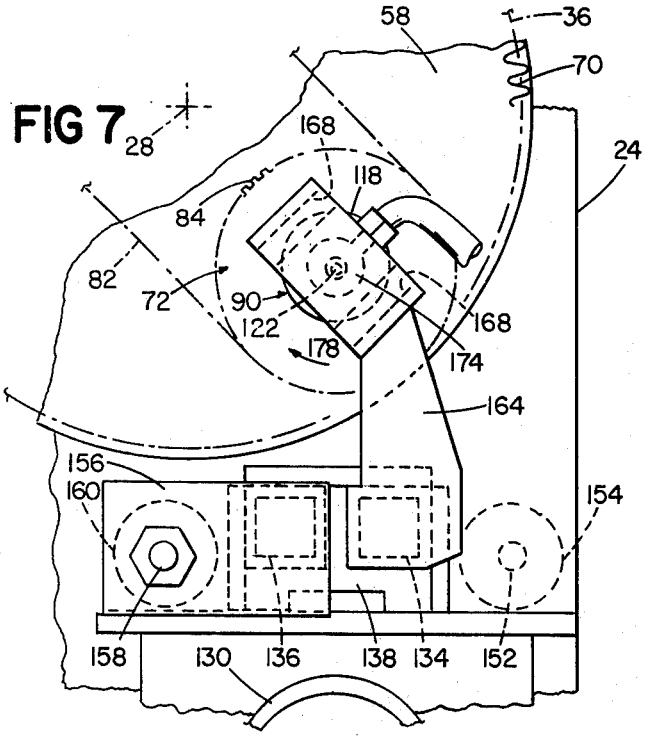
FIG. 7 shows the ejection mechanism of FIG. 2 along section 7—7.
Figure 8:
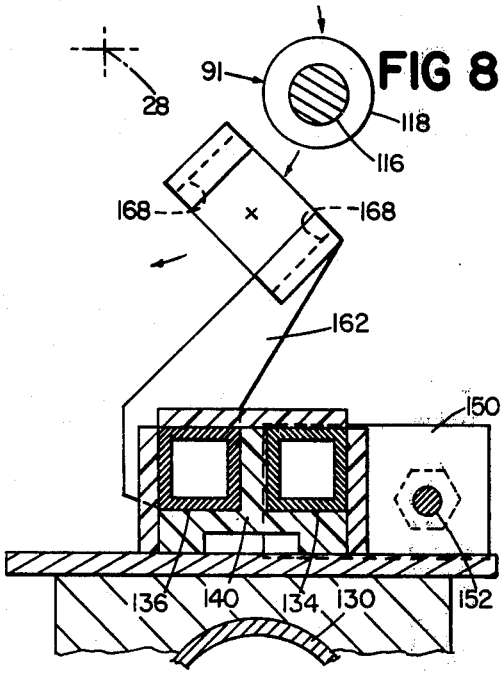
FIG. 8 shows the ejection mechanism along section 8—8.
Figure 9:
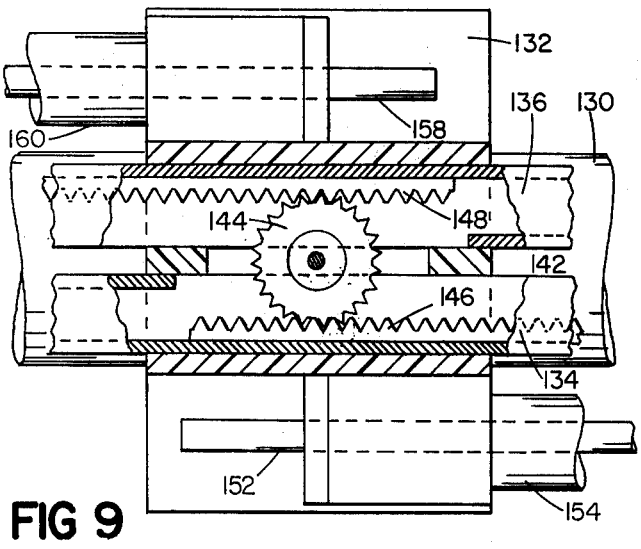
FIG. 9 shows the ejection mechanism along section 9—9.
Figure 10:
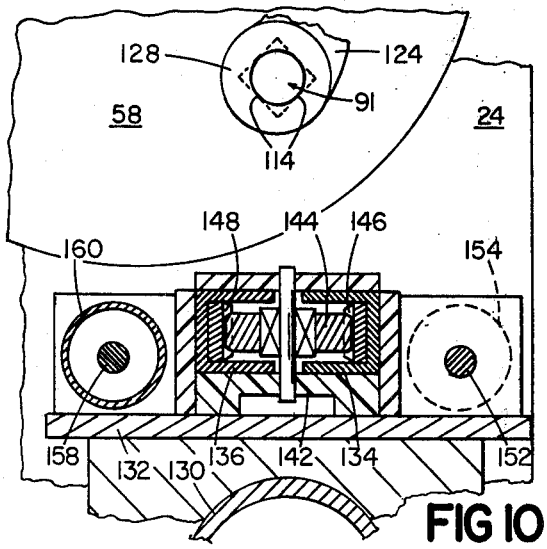
FIG. 10 shows the ejection mechanism along section 10—10.

Turning now to FIGS. 2 and 3, turret 18 includes two end hubs 58 disposed symmetrically on either side of the web path and affixed to each other by spacer rods 60. With only minor exceptions which will be noted, the construction of the right half of turret 18 is the mirror image of the left and it will be sufficient to describe the left side only. End hub 58 is affixed to stub axle 20 which is rotatably supported in bracket 22, and carries coaxially thereon drive sleeve 62 and drive sleeve 64, both sleeves being mounted for rotation relative to axle 20 and to each other. Outer groove 66 in sleeve 62 engages and is turned by belt 50, while outer groove 68 in sleeve 64 engages and is turned belt 48. Sprocket gear 70 engages and is turned by sprocket chain 30. Two identical quills 72, are mounted symmetrically 180° apart on each hub. Each quill has generally cylindrical shape and is supported on bearings so that it is free to rotate with respect to hub 58. Belt 76 engages cylindrical surface 78 on one quill and groove 80 of sleeve 62, while belt 82 engages cylindrical surface 84 of the other quill and groove 86 of sleeve 64. Quills 72 are hollow and within each is a carrier 88, and passing through each quill and carrier is arbor 90, the quill, carrier and arbor being coaxial. Each carrier 88 rotatably supports eight cam followers 92 disposed in two groups, each group having four followers arranged symmetrically around the axis of carrier 88 with the axes of the followers in a plane normal to the axis of the carrier and quill. Carrier 88 has four slots 94 cut in each end making its structure flexible and permitting flexure of followers 92 in the radial direction. The direction of flexure is shown by arrows 93 in FIG. 5. Conical surface 96 at end of carrier 88 fits against mating conical surface 98, of quill 72. Conical surface 100 at the outboard end of carrier 88 fits against a mating conical surface 102 of sliding insert 104. Retainer 106 threaded into quill 88 holds Belleville spring 108 against insert 104. The tightening of retainer 106 during assembly causes spring 108 to bear against insert 104, which in turn causes surface 102 of insert 104 to bear against surface 100 of carrier 88, and surface 96 of carrier 88 to bear against surface 98 of quill 72, with the result that quill 72 is frictionally engaged to carrier 88 and the structure of carrier 88 is flexed and cam followers are thrust radially inwards to engage the surface of arbor 90. Arbor 90 is turned from a square cross-section bar and has a portion 110 with the square cross section, which is generally within quill 72 as shown in FIG. 3, and inboard portion 112 with a round cross section extending nearly to the central plane of machine 10. The diameter of the inboard portion is slightly greater than the side of the square portion so that small flats 114 extend along the generally cylindrical surface of portion 112. The outboard end 116 of arbor 90 is cylindrical and has affixed thereto two ball bearings assemblies 118, 120 spaced from on another, which serve as rotatable flanges. A central bore 122 runs through arbor 90 from end to end. Collar support arm 124 is mounted on sliding sleeves 126 which slide along spacer rods 60, and rotatably support stripping collars 128 in positions concentric with the axes of quills 72. Collars 128 are snugly fit to arbors 90 and loosely fit within support 124.

Collar retraction mechanism 200 includes sleeve 126 affixed to shaft 202 and sliding through cap 203. Shaft 202 is connected to pneumatic piston 204 sliding in cylindrical bore 206 within axle 20 and forming a pneumatic cylinder. Passages 208 and 210 through axle 20 communicate with the opposite ends of bore 206. Rotary pneumatic connector 212 is supported on bracket 22 and connects pneumatic supply lines 214 and 216 respectively to passages 208 and 210 through rotary seals. Adjustable limit stop 218 mounted on rods 60 limit the inward motion of sleeves 126.

Turning now to extraction mechanism 52, pipe girt 130 is affixed to frame 24 and extends across the span of machine 10. Girt 130 supports platform 132 at the center of the span. Cross slides 134, 136 are positioned beside each other running across the span and are supported by slide bearing 138, 140 on the frame and 142 on platform 132.. Pinion 144 is supported with a vertical axis on platform 132 and engages racks 146 and 148 affixed respectively to slides 134 and 136. The motion of the two slides 134, 136 is thus linked through pinion 144 so that the slides are constrained to move equally in opposed directions across the machines.

The right end of slide 134 is connected through bracket 150 to shaft 152 of hydraulic cylinder 154, which is supported between platform 132 and the right side of frame 24. The left end of shaft 136 is connected through bracket 156 to shaft 158 of pneumatic cylinder 160, which is supported between platform 142 and the left side of frame 24.

Fork 162 is affixed to the right end of slide 136, while fork 164 is affixed to the left end of slide 134 as viewed in FIG. 2. Each fork 162, 164 has a slot 166 admitting bearing assemblies 118 and lips 168 pentrating between bearing assemblies 118 amd 120. Fork 164 has an extension with cylindrical bore 170. Pneumatic piston 172 is captured in bore 170 by cover 174 so that bore 170, piston 142, and cover 174 define chamber 176. Threaded hole 178 penetrates cover 174 to admit compressed air into chamber 176. Spring 180 biases piston 172 against cover 174. Hole 182 penetrates piston 172 along its axis between chamber 176 and butt end 184 and is closed by check valve 186 at its opening to chamber 176. Pneumatic fitting 188 attaches to hole 178 by flexible hose 190.

Figure 13:
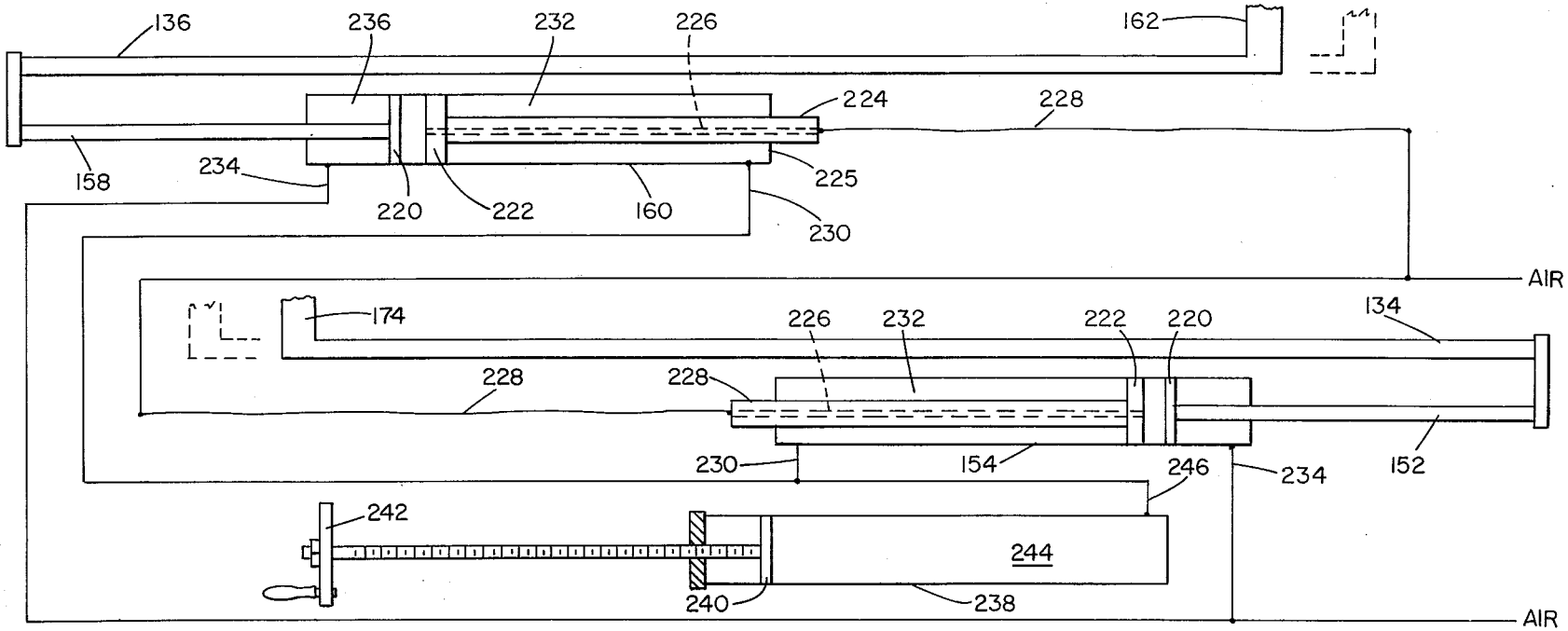
FIG. 13 shows an isolated and partly schematic view of the pneumatic and hydraulic components of the ejection mechanism of FIG. 2.

The construction and connection of cylinders 154 and 160 is shown more particularly in FIG. 13. Fitting within one end of cylinder 154, is piston 220 connected to shaft 158 which moves slide 136. Fitting within the other end of cylinder 220 is piston 222 connected to shaft 224 which extends out the end 225 of the cylinder. Shaft 224 has an axial passage 226 extending from the face of piston 222 to its outer end where it is connected to a flexible pneumatic line 228. Hydraulic line 230 is connected to cylinder 160 to deliver oil to the chamber 232 between end 225 and piston 222. Pneumatic line 234 is connected to deliver air to chamber 326 of cylinder 160. The construction cylinder 154 is the same as that of cylinder 160 except that it operates with its shaft to the right as shown in FIG. 13. Cylinder 238 has a piston 240 driven by crank 242 and defining chamber 244 which is filled with oil. Hydraulic line 246 communicates between chamber 244 and both of lines 230 leading to the two cylinders 154, 160. By cranking piston 240 in or out with crank 242 oil is supplied or withdrawn from chambers 232 to adjust the throw of the pneumatic pistons 220. Because chambers 232 are supplied by a common source and are in communication with each other the positions of pistons 220 will automatically adjust so that equal retarding forces will be applied to pistons 222 and a minimum of force will be transferred across gear 144.

Adjacent to station A are mounted enveloping roll 192 operated by pneumatic cylinder 194 and tucking blade 196 operated by pneumatic cylinder 198.

It is to be understood that pneumatic supplies and valving are appropriately connected to the apparatus described together with equipment to control the operation of the valves and clutches in the sequence as described below. Such equipment is well known to those skilled in the art and need not be here described.

The operation of winding machine 10 is cyclical and it will be convenient to describe the operation starting at an instant when a roll has been fully wound. At this time the arbors at station B are extended inwards from spindles 72 passing through stripping collars 128, and have their inboard ends opposed to each other across a very small gap at the center line of the machine. Cross slide 134 is extended along with shaft 152, to the right (as seen in FIG. 2) and cross slide 136 with attached shaft 158 are extended to the left, the situation being as shown in FIG. 2. Clutch 38 or 44 as appropriate will be disengaged so that the spindle 72 at station B is not rotating. The condition of the spindles and arbors at station A will be the same as those at position B except that a full roll of web will be wound on arbors 90, 91 between stripping collars 128. Piston 204 of collar retraction mechanism 200 is at its inboard limit with sleeve 126 seated against stop 218 and collars 128 against the roll of web at station A. The quill at station A will be rotating, being driven by the associated clutch sleeve and driving belts. On completion of the winding of the roll at station A, air is admitted to cylinder 206 to drive piston 204 outboard and draw collar support 124 and collars 128 to the position shown in FIG. 2. This withdrawal gets the collars out of the way of the tucking blade and the enveloping roll as will be described hereafter. Then turret 58 is rotated 180° clockwise (as viewed in FIG. 1) by drive gear 32 operating through sprocket chain 30. The result of this rotation will be to place the spindles and arbors carrying the wound roll at station B while the empty spindles and arbors are moved to station A, with the web drawn over the arbors at station A and passing across the turret to the outer winding of the roll now at station B. As the empty spindles move into station A they are put into rotation by the engagement of the appropriate one of clutches 38, 44. Enveloping roll 192 is then advanced by operation of cylinder 194 to a position between the arbors 90 at station A and rods 60 of turret 18. In moving into this position, enveloping roll 192 makes contact with the incoming web, pushing it around the arbors 90 at station A. At the same time tucking blade 196 is advanced by the operation of pneumatic cylinder 198 making contact with the portion of the web running from station A to station B, causing the web to snap so that the roll on station B is severed from the web supply. Then the tucking blade continues to advance and thrusts the free end of the web into the crevice between roll 192 and arbors 90. This action secures the free end of the web underneath the first turn of web on arbors 90 and the continuing rotation of the spindles at station A wind the web in successive layers around arbors 90. After the free end of the web has been secured under additional coils, enveloping roll 192 and tucking blade 196 are withdrawn and web is wound onto the arbors 90 at station A to produce a full roll. Turning now to the arbors carrying a filled roll, which have been advanced to station B by the rotation of turret 18, it should be noted that in moving into station B, bearing assembly 118 slips into slot 166 so that lips 168 are positioned between bearing assemblies 118 and 120 the same condition obtaining on both right and left arbor ends. After the arbors containing the filled roll have been positioned at station B, and eveloping roll 192 and tucking blade 196 have been withdrawn, piston 204 is driven inboard to move sleeve 126 against stop 218 and place collars 128 against the ends of the rolls on arbors 90. Then compressed air is admitted into chamber 176 and this drive piston 172 away from cover 174 so that end 184 engages and seals to the end of arbor 90. The continuing admission of compressed air then opens relief valve 186 so that air flows through hole 182 in piston 172, then through bore 122 in arbor 90 from which it emerges in the small gap between opposed arbors 90, 91 at the center of the machine. The compressed air then, as shown in FIG. 11, passes in an outboard direction between each of arbors 90, 91 and the roll of web wound thereon. This flow of air, it may be noted, passes outwards under both arbors to escape through the small space between stripping collars 128 and the ends of the web roll. The pressure of the air between arbor 90 and the roll expands the roll slightly and also lubricates it. At this point pneumatic cylinders 154 and 160 are actuated to move slide 136 and fork 162 to the right while slide 134 and fork 164 are moved to the left. The opposed motion of the two slides is maintained equal by the linkage through pinion 144 and racks 146, 148. As the motion of the slide starts, lips 168 acting on bearing assemblies 118 draw arbors 90 in the outboard direction through spindle 72 as shown in FIG. 12. The arbors are thus withdrawn from the roll of web, this withdrawal being facilitated by the expansion and lubrication of the air stream passing along the outer surface of each arbor. As the withdrawal progresses the air pressure between the roll and arbors is maintained by the equal motion of the two arbors while the roll is held centered by the stripping rolls. With this arrangement neither arbor will disengage from the roll and release the pressure while the opposed arbor is still engaged to a significant degree. As the withdrawal of the arbors proceeds, cam followers 92 ride on narrow flats 114 so that they maintain their alignment with respect to the square portion of the arbor on which they ride during the spinning part of the cycle. After the arbors have been fully withdrawn, the roll drops into chute 54. The operation of pneumatic cylinders 154 and 160 is then reversed and forks 162 and 164 are pushed back toward the machine center line, pushing the arbors 90 along with them by way of contact between lips 168 and bearing assembly 120. The air delivery to chamber 176 is terminated after the arbors have been pushed back to their inboard positions, and the machine is ready to start a new cycle as soon as the roll has been fully wound on the pair of arbors positioned at station A.

I claim

1. A winder suitable for winding plastic film in the absence of a winding core comprising a pair of axially aligned arbors, one protruding from each of two opposed side supports of the winder machine, the arbors moveable axially toward each other to a winding position and moveable away axially from each other for stripping from the wound roll, and means for introducing and maintaining pressurized air at the roll-engaged support surfaces of said arbors during said outward stripping movement of said arbors, as the arbors disengage the opposite ends of the roll, said means defining substantially equal length flow paths between the roll and the arbor in each direction from the point of introduction of air to each end of the roll, until the roll leaves the arbor.

2. The winder of claim 1 including restraints arranged to engage the opposite ends of the roll to restrain it axially during opposite, outward stripping movement of said arbors.

3. The winder of claim 1 wherein at least one of said arbors is hollow and is arranged to deliver said air to a space adjacent the inner ends of the arbors, from which space said air proceeds axially outwardly along said arbor surfaces to the ends of said roll.

4. The machine of claim 1 including a dependent drive means for driving each of said arbors dependently in said axial stripping motion.

5. A winder suitable for winding plastic film in the absence of a winding core comprising a pair of axially aligned arbors, one protruding from each of two opposed side supports of the winder machine, the arbors moveable axially toward each other to a winding position and moveable away axially from each other for stripping from the wound roll, and means for introducing and maintaining pressurized air at the roll-engaged support surfaces of said arbors during said outward stripping movement of said arbors, as the arbors, as the arbors disengage the opposite ends of the roll, said machine inluding a dependent drive means for driving each of said arbors dependently in said axial stripping motion, wherein the outer ends of said arbors have formations adapted to be engaged by axial drive devices, said arbors being indexable about a central major axis from winding position to discharge position, said drive means adapted to receive said formations on said arbors during said indexing, to apply axial stripping force and subsequent axial return force to said arbors and to release said arbors during subsequent indexing motion from the release to the drive position.

6. A winder suitable for winding plastic film in the absence of a winding core comprising a pair of axially aligned arbors, one protruding from each of two opposed side supports of the winder machine, the arbors moveable axially toward each other to a winding position and moveable away axially from each other for stripping from the wound roll, and means for introducing and maintaining pressurized air at the roll-engaged support surfaces of said arbors during said outward stripping movement of said arbors, as the arbors disengage the opposite ends of the roll, wherein axially extending flats are provided on each of said arbors and rollers engage said flats in supporting and rotatable driving relation thereto.

7. The winder of claim 6 wherein said flats extend to the inner ends of arbors, adapted to be engaged by said rollers during outward movement of arbors in stripping motion relative to said roll, said flats ensuring alignment of said arbors with their respective rollers throughout the series of motions.

8. The winder of claim 6 wherein said rollers are mounted on a carrier member and means are provided for displacing said radially carrier member of rollers toward the arbor axis thereby to cause the rollers to tightly engage said arbor.

9. The winder of claim 8 wherein the wedge formations are provided on said carrier member and means to apply axial force to said formations thereby to displace said carrier member in said radial direction.

10. The apparatus of claim 6 wherein a circular friction surface is engaged to apply force from the machine drive to a carrier, and via said rollers mounted on said carrier, to said arbors.

11. A winder suitable for winding plastic film in the absence of a winding core comprising a pair of axially aligned arbors, one protruding from each of two opposed side supports of the winder machine, the arbors moveable axially toward each other to a winding position and moveable away axially from each other for stripping from the wound roll, and means for introducing and maintaining pressurized air at the roll-engaged support surfaces of said arbors during said outward stripping movement of said arbors, as the arbors disengage the opposite ends of the roll, wherein the means for introducing air comprises a piston responsive to air pressure to be resiliently urged against the end of a said arbor and a relief valve operable by said air pressure for admitting air through said piston when said piston is engaged upon said arbor, said arbor having a passage for introducing said air to said arbor surface.

12. The winder of claim 1 including a tucking means arranged to tuck the leading edge of film about said pair of arbors to initiate the formation of a roll.

13. In a winder suitable for winding a web in the absence of a core, comprising arbor means, means for introducing air to the surface of the arbor, means for facilitating sliding of a roll produced on the arbor, and means engaging the roll for producing stripping motion of the roll relative to the arbor, the improvement comprising means localizing the introduction of the air along the length of the arbor through entry means defining substantially equal length flow paths between the roll and the arbor in each direction from the point of introduction of air to each end of the roll, until the roll leaves the arbor.

* * * * *

UNITED STATES PATENT AND TRADEMARK OFFICE

CERTIFICATE OF CORRECTION

PATENT NO. : 4,030,681

DATED : June 21, 1977

INVENTOR(S) : Charles M. Schott, Jr.

It is certified that error appears in the above-identified patent and that said Letters Patent are hereby corrected as shown below:

Col. 1, line 63, after "driving", insert --relation--;

Col. 3, line 10, after "chain 30.",insert the following: --(This sprocket gear is omitted on the right half of the turret.)--;

" 3, line 51 "on" should be --one--;

" 3, line 53, after "to end.", insert the following: --(This bore is omitted on arbors 91 to the right of the machine.)--;

" 4, line 9, delete the second period after "132."

" 4, line 14, "machines" should be --machine--;

" 4, line 49, "326" should be --236--; same line after "construction", insert --of--;

" 6, line 5, "drive" should be --drives--;

" 7, line 22, after "movement of said arbors," delete "as the arbors" (first occurrence);

" 8, line 10, delete "the".

Signed and Sealed this

Second Day of May 1978

[SEAL]

Attest:

RUTH C. MASON
Attesting Officer

LUTRELLE F. PARKER
Acting Commissioner of Patents and Trademarks